US005090503A

United States Patent [19]

Bell

[11] Patent Number: 5,090,503

[45] Date of Patent: Feb. 25, 1992

[54] VISUALLY INSPECTABLE SAFETY LANYARD

[76] Inventor: Michael Bell, 1705 Triumphe Way, Warrington, Pa. 19876

[21] Appl. No.: 605,284

[22] Filed: Oct. 29, 1990

[51] Int. Cl.[5] ..... A62B 1/14; A62B 35/00

[52] U.S. Cl. ..... 182/5; 188/65.4

[58] Field of Search ..... 182/3, 5, 6, 7, 8, 9; 188/65.1, 65.2, 65.4

[56] References Cited

U.S. PATENT DOCUMENTS

| | | | |
|---|---|---|---|
| 3,220,511 | 11/1965 | Holkesvich | 182/5 |
| 3,250,515 | 5/1966 | Hudnall | 182/5 |
| 3,444,957 | 5/1969 | Ervin | 182/3 |
| 3,804,698 | 4/1974 | Kinloch | 182/3 |
| 4,446,944 | 5/1984 | Forrest | 182/3 |
| 4,538,702 | 9/1985 | Wolner | 182/3 |

*Primary Examiner*—Reinaldo P. Machado
*Attorney, Agent, or Firm*—Caesar, Rivise, Bernstein, Cohen & Pokotilow, Ltd.

[57] ABSTRACT

A visually inspectable shock absorbing safety lanyard to reduce the shock of gravity when a person wearing a safety support system falls from an elevated position. The lanyard comprises a length of material having a first end adapted to be connected to the person, e.g., via a safety belt or harness, and a second end adapted to be connected to a fall prevention device, e.g. a rope grab, and a shock absorbing mechanism located therebetween. The shock absorbing mechanism is disposed within an inner cover to hold the mechanism in place, to keep it clean and to provide a visual indicator that the mechanism may have been tampered with or previously actuated. A readily openable second cover formed of a flexible material and including a releasably securable opening is disposed about the inner cover and is arranged when opened to provide visual access to the inner cover. In the preferred embodiment, the inner cover enclosing the shock is transparent so that the person using the lanyard also can visually inspect the shock absorber mechanism within the inner cover.

10 Claims, 4 Drawing Sheets

FIG. 3
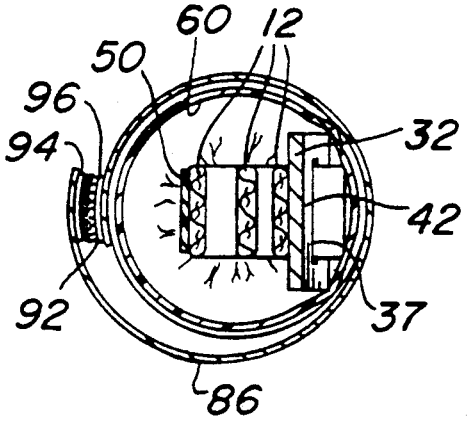
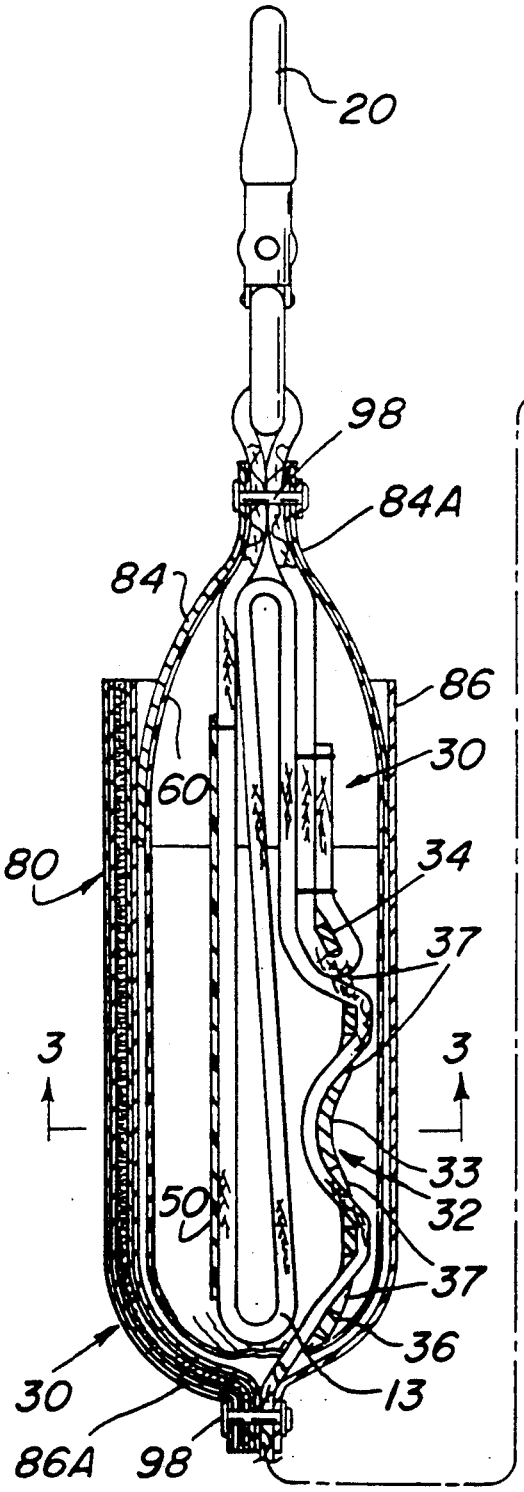
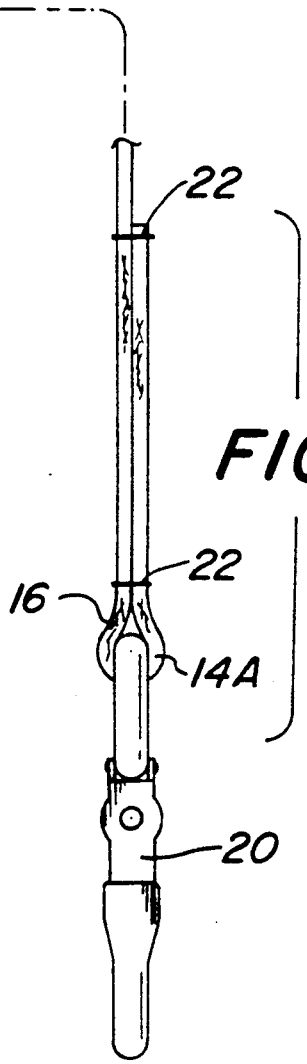
FIG. 2

12
5
20
104
96
102
64
106
14
94
108
92
14A
60
106
104
80
102
88
20
98
30
98
86A
100
5

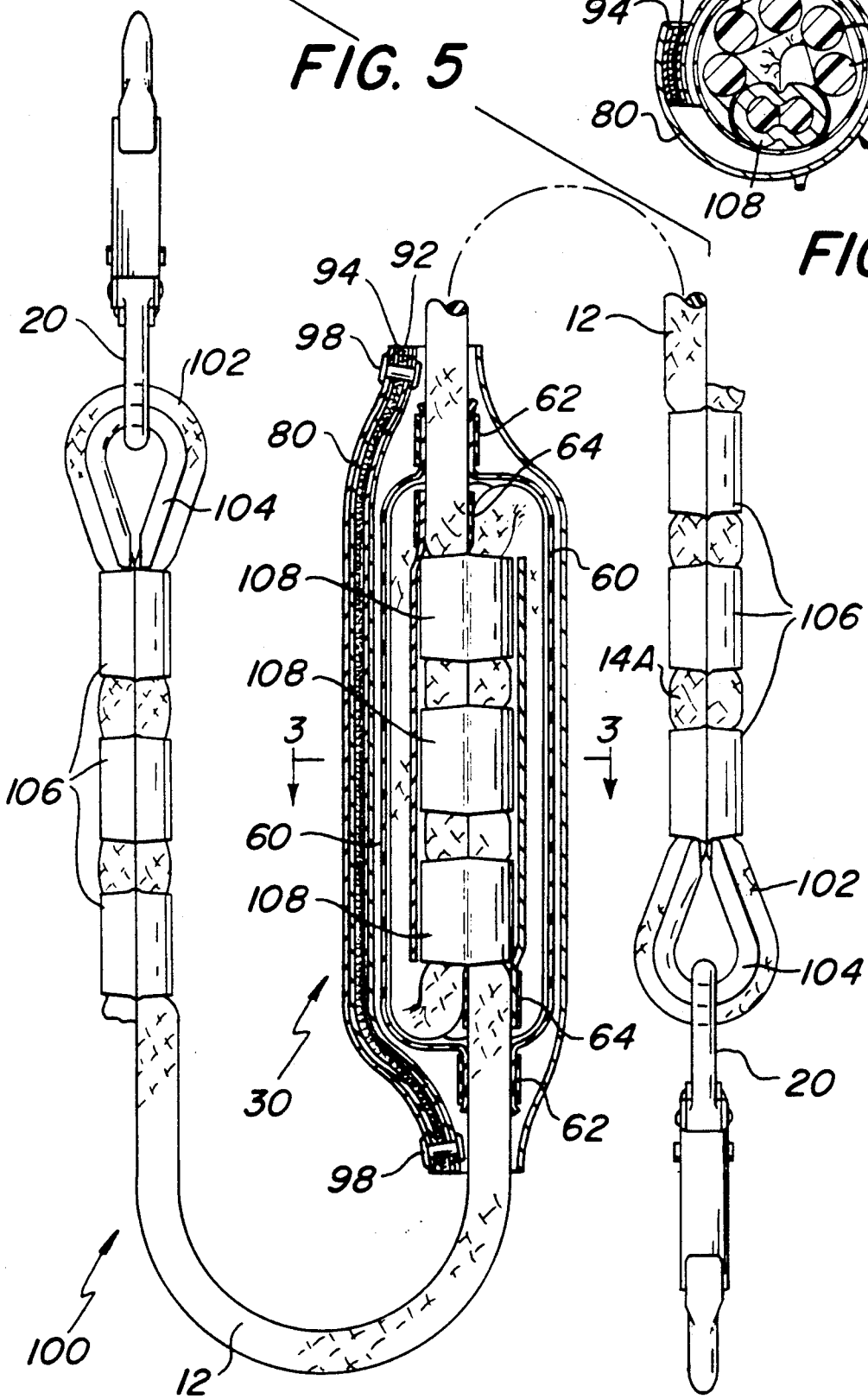
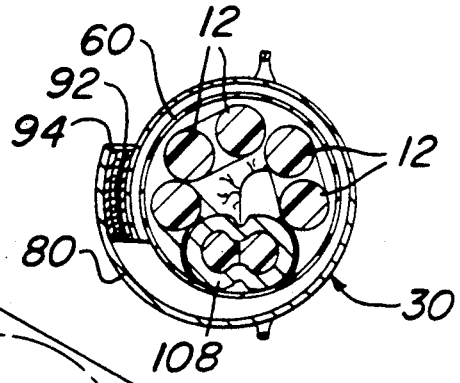
FIG. 6

VISUALLY INSPECTABLE SAFETY LANYARD

BACKGROUND OF THE INVENTION

Safety devices, such as harnesses, waist belts or other similar fall prevention devices are a requirement for persons working in elevated positions in accordance with government regulations and a desire for safety. In addition, sports enthusiasts such as rock and wall climbers may also wear these safety devices during such endeavors.

Generally, the person puts on the harness or waist belt which is then releasably secured to a lanyard. The lanyard, usually a three foot length of rope or webbed fabric, e.g., polyester, nylon, etc. with connection members at each end, is then releasably connected to a rope grab device or some other fixed holding member. In the case of a rope grab, the rope grab is in turn, attached to a independent safety line connected to an elevated structure. The safety line typically extends downward to a lower elevation or to the ground. In the event the person falls, the rope grab device, due to the initial jerk, will automatically activate and grab the safety line and thereby suspend the individual at or near the activation position.

The suspended person can then be rescued by a ladder, "cherry picker" or by utilizing a self-actuated lowering device to lower himself/herself to a lower elevation. Lowering devices are disclosed in the patent literature and some are commercially available to enable a suspended individual to initiate a safely controlled descent down a rope after the suspended person secures such a lowering device to the safety line. One such device is produced by Descent Control Inc., Fort Smith, Ark. as Model No. DT2&3 under the trademark SKY GENIE. The SKY GENIE device permits a person suspended from a safety rope to attach the device to the rope and descend down the rope. Other examples of such lowering devices are found in U.S. Pat. Nos. 3,220,511 and 3,250,515.

In my co-pending United States patent application, Ser. No. 466,898, filed on Jan. 18, 1990, entitled "Fall Prevention and Lowering System and Methods of Use", there is disclosed and claimed a safety system utilizing a robe grab and a lowering device for protecting persons located at elevated positions from falling while enabling such persons to safely descend.

As will be appreciated by those skilled in the art, during a fall from an elevated structure, due to a person's weight and the force of gravity, the tension on the lanyard increases almost instantaneously when the rope grab device is actuated to suspend the person from the safety line. The gravitational force is transmitted to and felt by the person connected to the lanyard. This gravitational force may stun the individual, or even knock the individual unconscious, thereby hampering the individual's ability to safely descend down the safety line with a lowering device, or otherwise aid in an assisted descent. More importantly, the shock of the gravitational force may cause the person to sustain an injury to the neck, head, back, e.g., whiplash.

To protect persons from or minimize the effects of such a shock, shock absorbing lanyards are commercially available. Such lanyards typically include a shock absorbing mechanism housed within a casing connected between the ends of the lanyard. One particularly effective shock absorbing lanyard is sold by Descent Control, Inc., of Fort Smith, AR, under the trademark SOFT LANDING. This lanyard relies on the frictional threading of a folded length of the lanyard in a serpentine path through a buckle (when webbed fabric is used) or through frictional ferrules (when a rope lanyard is used) to decrease the perceived shock. As tension is applied to the lanyard, the folded portion of the lanyard stored in the area above/alongside the buckle or frictional ferrules, passes therethrough. The frictional force imposed on the lanyard material by the buckle or frictional ferrules abates the gravitational shock felt when a person begins to fall.

To function properly, the conventional SOFT LANDING lanyard requires the folded portion of the lanyard frictionally passing through the buckle or frictional ferrules, to be properly folded, stored and protected from tampering, soiling or accidental activation. These concerns have typically been met by the use of some sort of a resilient cover. Although such covers over the shock absorber may provide some protection, it does not permit a user to readily inspect the shock absorber prior to use without potentially interfering with the later functioning of the device. Moreover, such covers do not provide a visual indication of whether the shock absorber had previously been tampered with or actuated.

Accordingly, a need exists for a visually inspectable shock absorbing lanyard to be used in any type of suspension or safety system.

OBJECTS OF THE INVENTION

It is therefore a general object of this invention to provide a shock absorbing safety lanyard which overcomes the disadvantages of the prior art.

It is a further object of this invention to provide a shock absorbing safety lanyard which permits a user to quickly and easily inspect the device before use to determine its operability.

It is yet another object of this invention to provide a device which can be quickly and easily inspected to determine if it has been tampered with, previously activated or may potentially malfunction.

It is still yet another object of the invention to provide a lanyard having a shock absorbing feature which is protected from being soiled, damaged, tampered with, or inadvertently and prematurely activated while being worn.

SUMMARY OF THE INVENTION

These and other objects of this invention are achieved by providing an improved shock absorbing safety lanyard for protecting a person from falling from an elevated position when connected by the lanyard to a fixed support or safety line. The lanyard has a first end arranged to be connected to the person wearing a safety harness or other device, a second end arranged to be connected to the fixed support and a shock absorber interposed between the first end and second end. The improvement in the safety lanyard comprises the combination of an inner cover enclosing the shock absorber to maintain the shock absorber in an actuatable state, and an outer, readily openable cover over the inner cover, the readily openable cover providing visual access to the shock absorber so that the person can visually distinguish, from the appearance of the inner cover, whether the shock absorber is in the actuatable state or is in a permanently altered state after actuation or tampering.

DESCRIPTION OF THE DRAWINGS

Other objects and many attendant features of this invention will become readily appreciated as the same becomes better understood by reference to the following detailed description when considered in connection with the accompanying drawings wherein:

FIG. 2 is an elevational view of the first embodiment of the lanyard of the present invention with the shock absorber shown in section taken along line 2—2 of FIG. 1;

FIG. 3 is a cross-sectional view of the shock absorber taken along line 3—3 of FIG. 2;

FIG. 5 is an elevational view of the second embodiment of the lanyard of the present invention with the shock absorber shown in section taken along line 5—5 of FIG. 4; and FIG. 6 is a cross-sectional view of the shock absorber of the second embodiment of the lanyard of the present invention taken along line 6—6 of FIG. 5.

DETAILED DESCRIPTION OF THE PREFERRED EMBODIMENTS

Figure 1:
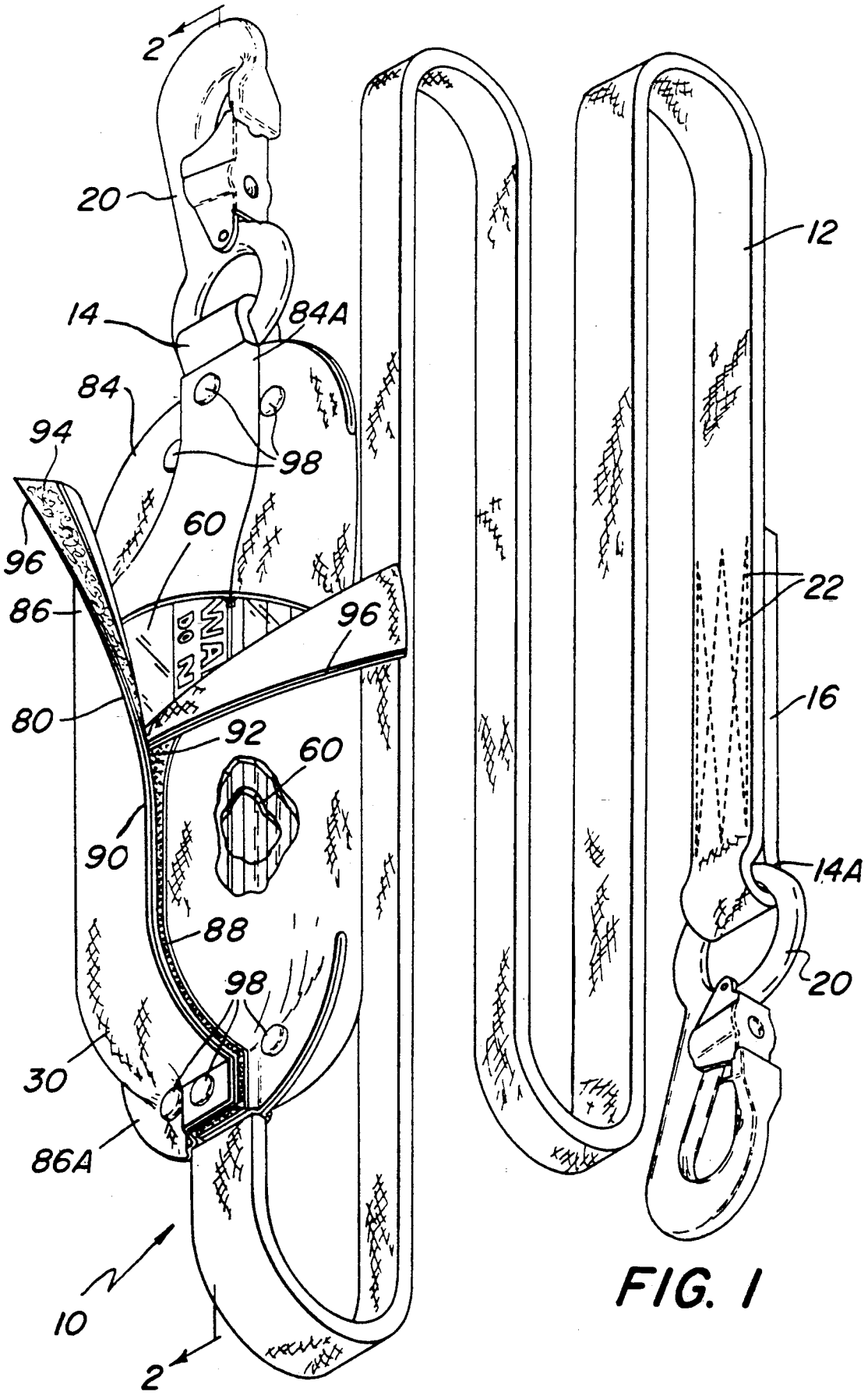
FIG. 1 is a perspective view, of the first embodiment of a lanyard constructed in accordance with the present invention, with part of an outer cover being opened to show internal details of construction.

Referring now to various figures of the drawings where like reference numerals refer to like parts, there is shown at 10 in FIGS. 1 and 2, the first embodiment of a device constructed in accordance with this invention.

The shock absorbing safety lanyard of the first embodiment 10 comprises an elongated strap of material 12, e.g., woven polyester, nylon, etc., having a first end 14 arranged for connection to a holding device, e.g., a conventional rope grab (not shown) and another, oppositely disposed second end 14A, arranged for connection to a waist belt or harness (not shown) which is worn by the person to be protected. Each of the ends of the lanyard 14, 14A, includes a conventional spring loaded clasp 20 fixedly secured thereto to enable the lanyard to be releasably connected as desired.

The lanyard 10 additionally comprises a shock absorber mechanism 30 located at an intermediate point along the length of strap 12. The portions of the shock absorber mechanism 30 which are actuatable are covered by an inner, preferably transparent, breakable cover 60 and that combination is housed within a readily openable cover 80, all to be described in detail below.

The shock absorber mechanism 30 is generally located closely adjacent the first end 14 of the lanyard 10, but may be located anywhere along the length of material 12. In the first embodiment 10 of this invention, as can be seen in FIGS. 2 and 3, the shock absorber mechanism 30 comprises a buckle 32 having an elongated body section 33. A plurality of slots 37 extend through the body section 33 and are spaced-apart along the elongated extent of said body. A length of the lanyard material 12 is threaded in a serpentine fashion through the slots 37 to provide frictional engagement between the lanyard material 12 and the body section of the buckle 32. Although the buckle 32, in the preferred embodiment of this invention includes four slots 37 through which the lanyard material is threaded (FIG. 2) in accordance with the broadest aspect of this invention the number of such slots 37 can be varied. The important feature is that the buckle be capable of cooperating with the lanyard to provide frictional engagement required for operation of the shock absorber mechanism 30.

Referring specifically to FIG. 2, a shock absorbing length 13 of the lanyard material 12 is folded upon itself, in overlying relation to the buckle 32, and, along with the buckle 32, is disposed within of the buckle 32 within the inner cover 60. When tension is applied to the lanyard, the breakable, transparent cover 60 stretches, tears or breaks apart as the first and second pieces 84 and 86 respectively, of openable cover 80 separate. The shock absorbing length of material 13 then frictionally passes through the spaced apart openings 37 in the buckle 32 when the shock absorber mechanism is actuated.

In order for the shock absorber mechanism 30 to properly function, the stored, shock absorbing length 13 of lanyard material 12 must be properly folded and stored. Moreover, this length 13 must be protected from being soiled, tampered with, or inadvertently tangled or dislodged during use but prior to activation. Protection from these concerns is provided by the inner cover 60 which covers and properly positions the stored, shock-absorbing material 13 in the desired orientation and which has a unusual appearance that is permanently altered when the shock absorber mechanism either has been tampered with, or has been previously actuated.

In accordance with this invention the inner cover 60 must be able to stretch, tear or break apart when a person either intentionally or inadvertently tampers with the shock absorber mechanism 30, or when the mechanism has been actuated with the length 13 of lanyard material 12 moving through the buckle 32. In the preferred embodiment of this invention the inner cover 60 is transparent to permit visual examination of the shock absorber mechanism 30 prior to its use. Most preferably the inner cover 60 is a heat shrinkable, transparent plastic film such as polyethylene and actually is heat shrunk into close conformity with the shock absorber mechanism 30 to aid in properly positioning the stored length of shock-absorbing material 13 until it is drawn into use. The permanently altered visual appearance of the inner cover 60 resulting from actuation of, or tampering with the shock absorber mechanism 30, e.g., torn, stretched or broken, indicates to a potential user of the device 10 that it should not be used, but instead should be properly inspected and/or serviced by the manufacturer.

The device 10 also preferably contains a warning label 50 attached to the inner cover 60 (FIG. 2) which warns the individual not to use the device if it has been tampered with or previously subjected to a fall-associated shock, as evidenced by the condition of the inner cover 60, upon visual inspection thereof.

Referring to FIG. 1, a readily openable cover 80 surrounds the inner cover 60. This readily openable cover 80 is comprised of a first piece 84, and a second piece 86 having a longitudinal opening 88 therein. The readily openable cover 80 is preferably made from a resilient material such as vinyl or other plastic material, and is preferably made cylindrical in shape, although any suitable shape may be utilized. The openable cover 80 is secured to the length of material 12, at each cover end 84A and 86A, respectively. Although it is not necessary, it is preferable that the second piece 86 overlap the first piece 84 to prevent or impede the entry of foreign objects while the lanyard 10 is worn.

The first piece 84 is fixedly secured below the first end 14 of the length of material 12 by a rivet 98, and extends towards the second end 16 of the length of material 12. Additional rivets 98 may also be used to close the end 84A of the first piece 84. The second piece 86 is fixedly secured on the length of material 12, below the lower end 36 of the buckle 32. Although any means of securement may be utilized, it is preferable that conventional rivets 98 be used for durability, which also preferably are used to close the end 86A of the second piece 86. In order to inspect the shock absorber mechanism 30, it is necessary that the cover 80 be easily openable. To that end, the longitudinal opening 88 on the second piece 86 has a releasable securement member 90 secured along the edges 96 thereof. The releasable securement member 90 comprises a first component 92 having a plurality of hooks and a second component 94 having a plurality of loops. When the first and second components are brought into engagement upon closing, the hooks and loops interlock to hold the components 92 and 94 together. Although any other suitable releasable securement member may be used such as a zipper, etc., it is preferable that the securement member it be comprised of VELCRO to withstand exterior weather conditions.

As shown in FIG. 1., the connecting members 20 used to connect the lanyard 10 are of a conventional type formed from metal and are preferably releasably connectable to any desired structure or device (e.g., body harness or waist belt, rope grab, safety line.) The connecting members 20 may be secured to the lanyard material 12 in any fashion, however it is preferable that ends of the length of material 12 be folded over the members 20 and stitched with stitching 22 at the second end 16 of the lanyard 10 and with a rivet 98 at the first end 14 of the lanyard.

Figure 4:
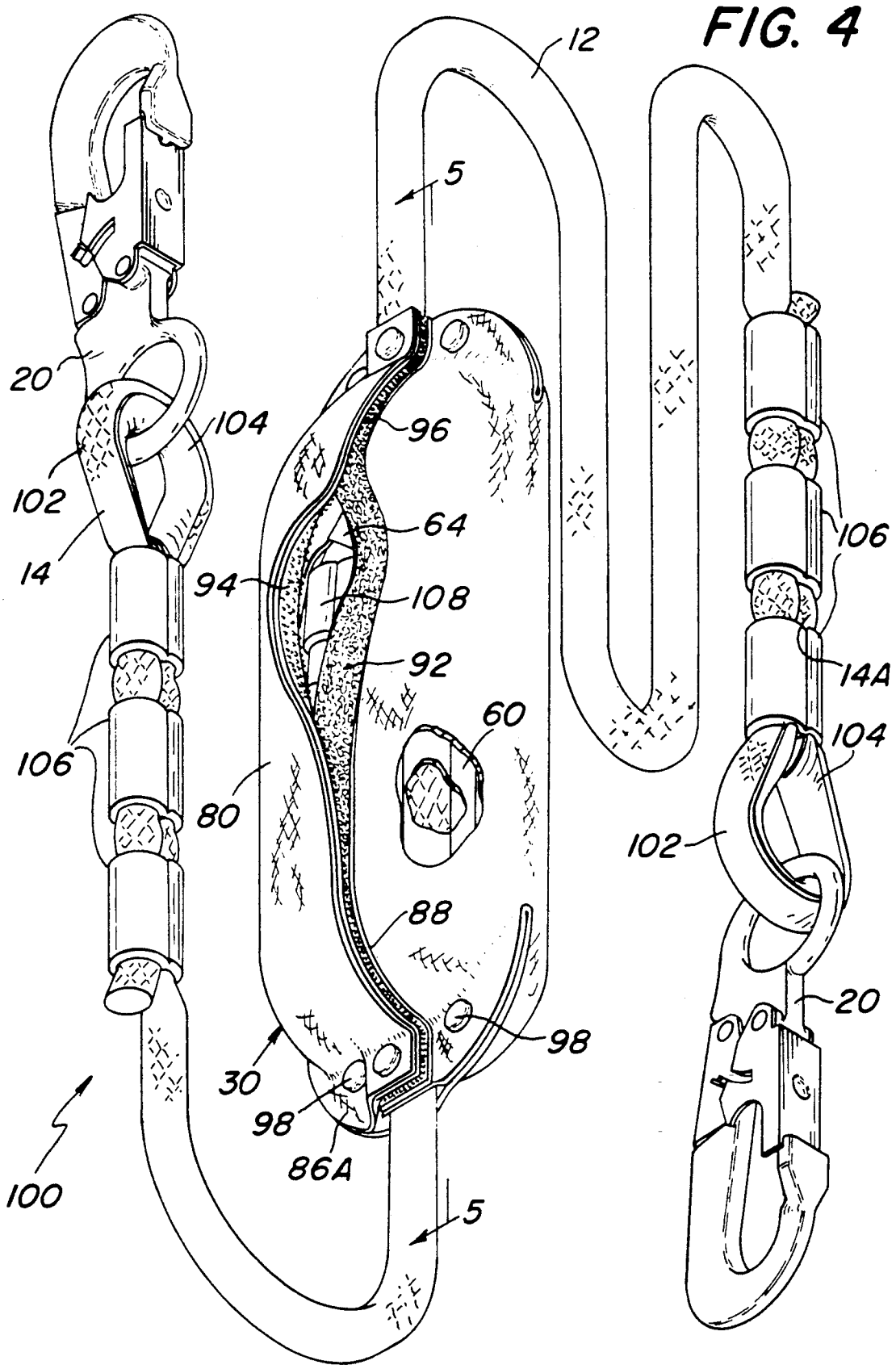
FIG. 4 is a perspective view of a second embodiment of the lanyard of the present invention utilizing rope.

As shown in FIGS. 4–6, the second embodiment 100 of this invention is similar in many respects to the first embodiment previously described. To that end, components which are identical to those described in the first embodiment are given the same reference numbers, and in the interests of brevity, their description and function will not be repeated.

In the second preferred embodiment 100, the length of material 12 of the lanyard 10 is comprised of a high-strength rope rather than the webbed fabric of the first preferred embodiment 10. At each end 14 and 14A of the lanyard, the rope is folded over to form loops 102 about the connector member 20. The folded over rope sections are secured with conventional ferrules 106. The inside of the loops 102 contain a conventional guard 104 comprised of a metal or other durable material to prevent the connector 20 member from frictionally damaging the rope loops 102 during use of the lanyard.

As shown in FIGS. 5 and 6, the shock absorber mechanism 130 of the second preferred embodiment 100 functions in a similarly frictional manner to the previously described shock absorber 30. However, the shock absorber mechanism 30 utilizes frictional ferrules 108 through which a folded portion 113 of the rope passes upon the impact of a fall (instead of through the buckle member 32 in the previously described device 10). To that end, the ferrules 108 are secured to the rope with enough force to provide the desired shock absorbing function, by permitting the rope to pass frictionally therethrough upon impact. In contrast, the ferrules 106 which secure the loops 102 of the rope about the connecting members 20 must be fixedly secured to lanyard length 12 to maintain the integrity of the device during a fall. Although in the second preferred embodiment the readily openable cover 80 is shown as a one piece member, it should be readily apparent that the cover 80 may also be made of two pieces as in the first embodiment. In addition, the transparent cover 60 in this embodiment is easily secured at either end about the frictional ferrules 108 with the use of a tape or adhesive band 62. The warning label 50 as well, is best secured in this embodiment by adhesive tapes or bands 64.

Without further elaboration the foregoing will so fully illustrate my invention that others may, by applying current or future knowledge, adopt the same for use under various conditions of service.

I claim:

1. In a shock absorbing safety lanyard for protecting a person wearing a body engagement safety means from falling from an elevated position when connected by the lanyard to a fixed support, the lanyard having a first end to be connected to the person wearing the body engagement safety means for securing the person to a safety system, a second end arranged to be connected to the fixed support and shock absorber means for absorbing the shock of a fall, the shock absorber means being located between the first end and the second end, the improvement comprising the combination of an inner cover and outer cover enclosing the shock absorber means, said inner cover closely surrounding the shock absorber means for maintaining the shock absorber means in an actuatable state and for providing a visual indication of whether the shock absorber means is in the actuatable state or has been transformed therefrom, said outer cover being disposed about the inner cover to prevent inadvertent damage to said inner cover and said shock absorber means, said outer cover being readily openable to provide visual access to the inner cover so that the person can visually distinguish, from the appearance of the inner cover, whether the shook absorber means is in the actuatable state or is in an altered state.

2. The lanyard of claim 1 wherein the inner cover is a heat shrinkable, plastic material in close conformity with the shock absorber means.

3. The lanyard of claim 2 wherein the heat shrinkable, plastic material is transparent.

4. The lanyard of claim wherein the readily openable cover includes releasably securable opening means to provide access to the inner cover.

5. The lanyard of claim 4 wherein said releasably securable opening means comprises cooperating hook and loop fastening components.

6. The lanyard of claim 1 wherein the readily openable cover is formed of a flexible material.

7. The lanyard of claim 6 wherein the readily openable cover includes releasably securable opening means to provide access to the transparent cover.

8. The lanyard of claim 7 wherein the releasably securable opening means comprises cooperating hook and loop fastening components.

9. The lanyard of claim 4 wherein the inner cover is a heat shrinkable, plastic material in close conformity with the shock absorber means.

10. The lanyard of claim 9 wherein the heat shrinkable, plastic material is transparent.

* * * * *